United States Patent [19]

Flieter

[11] Patent Number: 4,759,261

[45] Date of Patent: Jul. 26, 1988

[54] THREE-WAY THREE-POSITION VALVE FOR COOLING A REVERSIBLE HYDRAULIC MACHINE

[75] Inventor: Wilhelm Flieter, Hattingen/Ruhr, Fed. Rep. of Germany

[73] Assignee: G. Düsterloh GmbH, Sprockhövel, Fed. Rep. of Germany

[21] Appl. No.: 808,433

[22] Filed: Dec. 12, 1985

[30] Foreign Application Priority Data

Dec. 18, 1984 [DE] Fed. Rep. of Germany ..... 3446134

[51] Int. Cl.[4] ..... F15B 11/08; F16K 17/18; F16K 31/122

[52] U.S. Cl. ..... 91/420; 91/451; 91/452; 137/112

[58] Field of Search ..... 91/451–452, 91/432, 446, 468, 46, 486, 420; 137/112

[56] References Cited

U.S. PATENT DOCUMENTS

| | | | |
|---|---|---|---|
| 795,410 | 7/1905 | North | 91/446 X |
| 1,767,061 | 6/1930 | Funk | 91/46 X |
| 2,401,258 | 5/1946 | Livers | 91/446 X |
| 3,636,708 | 1/1972 | Karman et al. | 91/452 X |
| 3,811,458 | 5/1974 | Kuhnelt | 91/446 X |
| 3,925,987 | 12/1975 | Faisandier | 137/112 X |
| 4,040,439 | 8/1977 | Uppal | 91/451 X |
| 4,461,314 | 7/1984 | Kramer | 91/448 X |

*Primary Examiner*—Robert E. Garrett
*Assistant Examiner*—George Kapsalas
*Attorney, Agent, or Firm*—Michael J. Striker

[57] ABSTRACT

A valve for cooling a reversible hydraulic machine includes a valve piston in a connecting channel extending between supply and discharge passages. Pressure in these passages displaces the spring-centered piston from neutral position to an end position. A central reduced-diameter portion of the piston carries a spring-centered closing member which closes a discharge conduit leading to a leakage space when the piston is in its central position. When the piston is displaced out of the neutral position toward one of the end positions, pressure from one of the connecting passages which has the lower pressure prevailing therein is permitted to propagate through one of the spring-receiving spaces delimited by the closing member and through an annular throttling gap present between the closing member and the central portion of the piston into the other spring receiving space and from there into the discharge conduit and into the leakage space.

8 Claims, 4 Drawing Sheets

THREE-WAY THREE-POSITION VALVE FOR COOLING A REVERSIBLE HYDRAULIC MACHINE

BACKGROUND OF THE INVENTION

The present invention relates to hydraulic machines in general, and more particularly to a cooling arrangement for such machines, especially for reversible hydraulic motors.

In a hydraulic machine, such as in a hydraulic radial piston motor, energy losses come into being as a result of mechanical friction between relatively moving parts and hydraulic medium flow leakage and friction, which energy losses are reflected in a warming up of the machine. In addition thereto, pressure losses due to the formation of leakage currents along the respective sealing gaps or interfaces of such a machine result in conversion of hydrostatic energy into heat. The resulting heat is then either radiated by the machine housing into the ambient atmosphere, or transported away by the volumetric leakage current, and usually both.

DESCRIPTION OF THE PRIOR ART

Even though the hydraulic machines which have been recently put into or are currently in operation already possess very good efficiencies, which is, among others, also attributable to the production of only small amounts of heat losses in such machines, the utilization limit of such machines, especially in continuous operation and/or at high power, is determined, to a large degree, by the thermal loadability of such machines. Namely, if the generated heat can no longer be removed from the machine to a sufficient degree, then the temperature in the machine increases to unacceptably high levels. The results of such temperature increases include direct damage to the machine, for instance, to the seals, as well as damages attributable to lubricating film disintegration or to decomposition of the pressurized medium additives.

Moreover, the danger of a thermal overloading is present to an increased degree by the fact that the marketplace requires increasingly compact devices with increased power. Furthermore, such devices or machines must have as low as possible leakage currents for achieving a high efficiency, a good running even at low rotational speeds, and good regulating properties.

It is already known in high-power drives to remove the heat in such a manner that a cooled rinsing volume current is added to the leakage volume current via a rinsing conduit, this additional volumetric flow then being removed from the machine together with the volumetric flow attributable to the leakage. This possibility of heat removal, while having proven itself as being quite effective, is extraordinarily expensive and thus costly. One reason for this is the need for providing an additional cooling device next to the pump. A further reason is to be found in the need for providing the additional conduit which must be installed before this feature can be utilized. Consequently, additional problems are encountered in many applications, which problems either cannot be overcome, in which case this approach cannot be used, or detract from the effectiveness of this cooling approach.

SUMMARY OF THE INVENTION

Accordingly, it is a general object of the present invention to avoid the disadvantages of the prior art.

More particularly, it is an object of the present invention to equip a hydraulic machine, especially a hydraulic motor, with a cooling arrangement which does not possess the disadvantages of the known cooling arrangements.

Still another object of the present invention is to provide a distributing valve arrangement particularly for use in a cooling arrangement of the above type, which is relatively simple in construction, inexpensive to manufacture, easy to install and use, and reliable in operation nevertheless.

It is yet another object of the present invention so to construct the cooling arrangement of the type here under consideration as to be able to dispense with expensive external additional devices and with additional conduits which are required when such additional devices are being used.

A concomitant object of the present invention is to develop a reversible hydraulic machine with an effective heat removal despite the absence of the aforementioned additional devices and conduits.

In pursuance of these objects and others which will become apparent hereafter, one feature of the present invention resides in a distributing valve arrangement for a reversible hydraulic machine, particularly a hydraulic motor, which machine has two connecting passages for the supply and discharge of a hydraulic operating medium at different pressures to and from the machine. The distributing valve arrangement of the present invention comprises means including a circumferential surface for bounding a connecting channel between the connecting passages; a piston received in the connecting channel for displacement in opposite directions from a neutral position thereof and including two piston heads having respective end faces, and a reduced-diameter central portion extending between the piston heads; spring means for biasing the piston toward the neutral position thereof; means for admitting the hydraulic operating medium from each of the connecting passages to a different one of the end faces for the higher of the pressures prevailing in the connecting passages to displace the piston against the action of the spring means out of the neutral positions and toward a respective end position thereof; means for discharging the hydraulic operating medium from a region of the connecting channel that is delimited by the piston heads and the central portion of the piston; a closing member carried by the central portion of the piston and slidingly supported on the circumferential surface of the bounding means, the closing member delimiting two spring-receiving spaces in the region; centering spring means received in the spring-receiving spaces and urging the closing member toward a central position thereof relative to the piston, in which it interrupts communication between the region and the discharging means when the piston is in the neutral position thereof; and means including a hydraulic resistance for establishing communication between the spring-receiving spaces. In this context, it is particularly advantageous when the piston includes communication control means for interrupting communication of the spring-receiving spaces with associated ones of the connecting passages in the neutral position of the piston, and for establishing such communication with only that of the connecting passages which has the lower pressure prevailing therein during the displacement of the piston toward the respective end position thereof.

Thus, it may be seen that one of the most important features of the present invention is based on the expedient of branching off a constant volumetric current from the pressure or connecting conduit or passage which has the lower of the two pressures prevailing therein (for instance, from the discharge passage of a radial piston motor) and supplying such branched-off medium flow to a location to be cooled. Inasmuch as the operating medium having the lower pressure is also at a lower energy level, the disadvantages of an increased leakage (deterioration of the efficiency, increase in the loss heat, and worsening of the running) no longer exist in most of the hydraulic circuit arrangements of hydraulic machines, especially hydraulic motors as, for instance, radial piston motors.

In the arrangement according to the present invention, there is provided, in principle, a hydraulically switchable three-position three-way valve with an integrated flow-regulating valve arranged downstream thereof. In this construction, the axial end faces of the piston which constitute the switch-over surfaces are being permanently acted upon by the pressure of the hydraulic operating medium then prevailing in the respectively associated connecting or pressure passage. When the pressures in the connecting passages are equal to one another, or when zero pressure exists in such passages, then the piston is held in its neutral position. This has the advantage in the practical application that spasmodic or jerky rotational speed changes during the start-up operation of the machine or during the change of the operating quadrant are reliably avoided. However, if one of the pressure or connecting passages contains the hydraulic operating medium at a higher pressure than the other passage, then the piston is displaced against the elastic force of a spring which is arranged at one axial end of the piston and connects the pressure or connecting passage with the lower pressure of the hydraulic operating medium therein with the current or flow regulating valve constituted by the two spring-receiving spaces as well as the closing member which is centered between the springs carried by the piston.

In the neutral position of the piston, the discharge conduit from the connecting channel is closed by the closing member. However, once the piston has been displaced out of its neutral position, even the spring-centered closing member which is carried by the reduced-diameter portion of the piston has left its original closing position in the direction toward the pressure or connecting passage with the lower hydraulic medium pressure therein. Thus, as soon as the hydraulic medium from the connecting passage with the lower pressure therein starts flowing into the spring-receiving space which is in communication with this lower-pressure connecting passage in the now displaced position of the piston, there is obtained a pressure differential at the closing member, as a result of which the closing member is displaced relative to the piston in the axial direction against the force of the centering spring arrangement acting thereon. Herein, the flow-through cross-sectional area of communication with the discharge conduit is gradually increasingly diminished, so that an increased pressure gradually builds up even in the spring-receiving space which is connected to the discharge conduit. Over time, however, the closing member assumes such an equilibrium or control position that the volumetric flow into the discharge conduit has a substantially constant value independently of the pressure prevailing in the connecting passage with the lower hydraulic medium pressure therein. Thus, there is obtained a regulating operation akin to that encountered in the conventionally constructed flow-controlling valves. Herein, the amount of the volumetric flow passing through the valve arrangement can be influenced in relatively wide limits by the selection and coordination of the various springs, flow-through cross-sectional areas and the dimensioning of the hydraulic resistance.

A particularly simple and reliable construction of the arrangement of the present invention which is easily dimensionable is obtained when, in accordance with an advantageous aspect of the present invention, the closing member has an annular configuration, and the hydraulic resistance is constituted by an annular throttling gap positioned between the closing member and the central portion of the piston. In this context, it is merely to be assured that the closing member can slide in the connecting channel without encountering any obtructions to such sliding displacement.

Advantageously, the piston is provided at the end faces of the piston heads thereof with annular projections. This expedient employed in the framework of the construction of the valve arrangement of the present invention as a sliding or spool valve provides an assurance that the switching end faces are supplied under all circumstances, that is in all positions of the piston, with the pressure of the hydraulic operating medium from the associated one of the connecting passages.

According to another advantageous facet of the present invention, the admitting means includes connecting bore means in the piston heads which lead from the respective connecting passages to the respective associated end faces of the piston heads. These bore means may advantageously include transverse bores in the piston heads as well as axial tapping bores between the transverse or radial bores and the respective end faces of the piston. A particular advantage of this construction resides in the fact that the piston is free, in all of its positions, from hydrostatic forces acting unbalancedly transversely of the axis of displacement. Such unbalanced transverse forces could otherwise result in an increased friction between the piston and the surface bounding the connecting channel.

When the valve arrangement of the present invention is to be constructed as a seat valve, it is advantageous when, according to another concept of the present invention, the piston heads include sleeve-shaped extensions which are hollow and communicate with the respective ones of the spring-receiving spaces, and there are further provided spring-loaded closing elements which abut the sleeve-shaped extensions. In this construction, longitudinally extending bores are provided in the sleeve-shaped extensions, these longitudinal bores communicating, via respective transverse bores, with the spring-receiving spaces associated therewith, and with pressure spaces arranged at the end faces of the closing elements. The annular spaces of the piston heads around the sleeve-shaped extensions are then in communication via respective channels with the associated pressure or connecting passages.

In this connection, it is particularly advantageous when there are further provided respective sockets received in the connecting channel and provided with respective sealing seats, and when the closing elements are spherical, are received and guided in the sockets, and cooperate with the sealing seat to interrupt communication between the respective connecting passages and the associated spring-receiving spaces unless lifted off from the sealing seats by the sleeve-shaped extensions. In this case, when the piston is displaced, one sleeve-shaped extension thereof pushes one of the spherical closing elements away from its associated sealing seat, thus admitting into the interior of the extension the hydraulic operating medium which has the lower pressure due to the communication of the interior of the associated socket with the connecting passage with the lower pressure. Thus, this pressure can now propagate, and the hydraulic operating medium can flow, past the respective lifted-off closing element and through the adjacent sleeve-shaped extension into the associated spring-receiving space and eventually reach the discharge conduit via the hydraulic resistance provided at the closing member.

An unproblematical installation of the valve arrangement is achieved when, in accordance with another facet of the instant invention, the piston includes two separate parts which are centered with respect to one another substantially at the central region of the piston. In this construction, the separate parts of the piston can easily be assembled with one another by inserting a portion of one of such parts into a corresponding recess of the other of these parts of the piston, and radial deviation of such piston parts with respect to one another is simultaneously avoided.

The valve arrangement constructions according to the present invention can be easily integrated, without running into any problems, particularly in the region of the control of a hydraulically energizable radial piston motor. To achieve this, it is merely necessary to permanently connect the pressure ports of the radial piston motor with the switching end faces of the valve piston.

The novel features which are considered as characteristic of the invention are set forth in particular in the appended claims. The improved arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
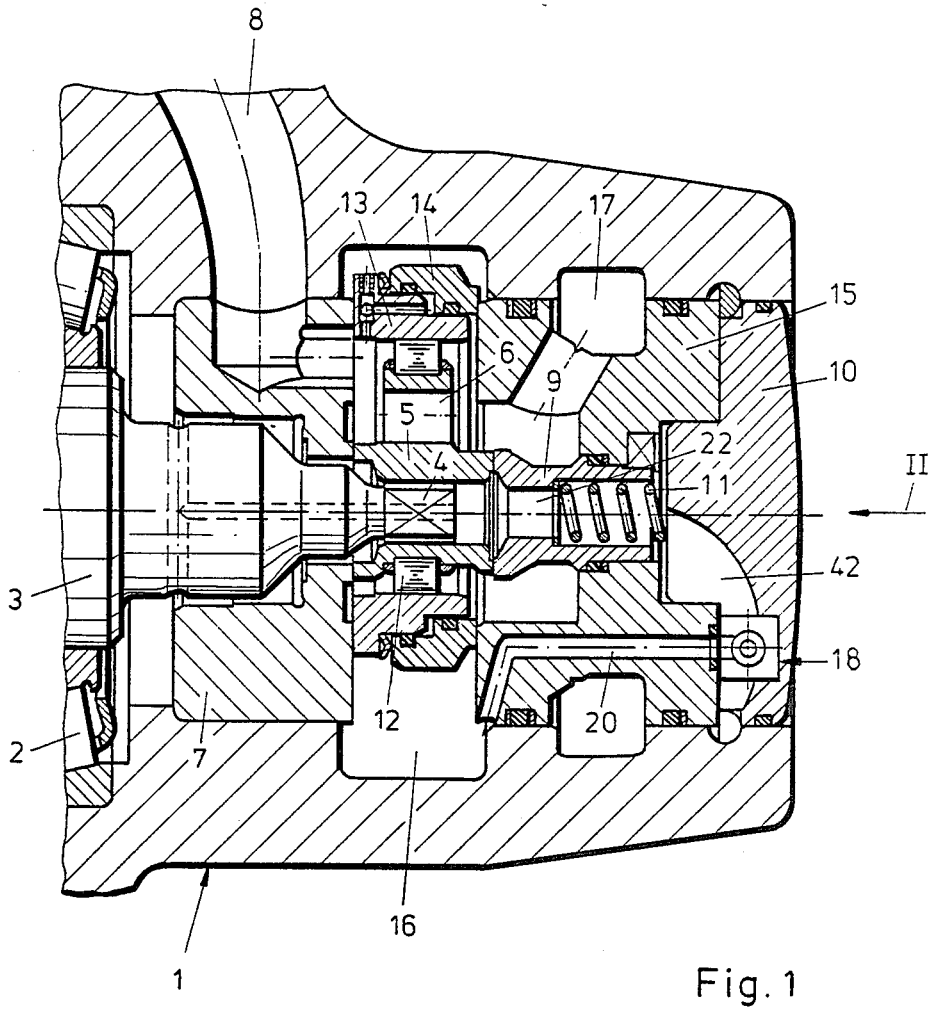
FIG. 1 is a longitudinal sectional view of an end portion of a hydrostatic radial piston motor embodying a cooling arrangement of the present invention.

Referring now to the drawing in detail, and first to FIG. 1 thereof, it may be seen that the reference numeral 1 has been used therein to identify a housing of a hydrostatic radial piston machine, especially a motor. A shaft 3 is supported in the housing 1 for rotation about its longitudinal axis by bearings 2. The shaft 3 includes, at the region of one of its ends, a non-circular portion 4, which may preferably have a polygonal cross section and on which there is mounted an eccentric disk 5 that is provided with at least one recess or aperture 6. The eccentric disk 5 is axially supported, on the one hand, on a control disk 7 provided with channels 8 leading to respective operating cylinders and, on the other hand, on a cylindrical pressure member 9 which is, in turn, axially supported on a housing lid 10, which is connected to the housing 1, by means of a helical compression spring 11.

A roller bearing 12 is provided around the outer circumference of the eccentric disk 5. The roller bearing 12 is received in the interior of a ring 13 which is axially supported on the control disk 7. Externally around this ring 13, there is arranged a further ring 14 which is distanced by an operating medium and which is axially supported on a pressure block 15 supported in the housing 1. The reference numerals 16 and 17 indicate pressure connection channels for the hydraulic operating medium.

Figure 2:
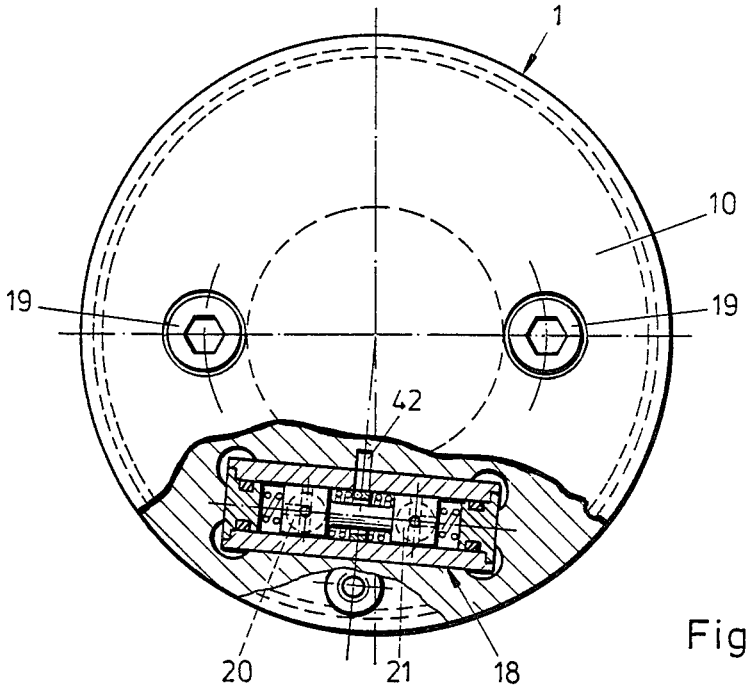
FIG. 2 is a partially cross-sectioned end view of the radial piston motor of FIG. 1 taken in the direction of an arrow II in FIG. 1.

As a comparison of FIGS. 1 and 2 in conjunction with one another will reveal, a cooling valve arrangement 18 is held by the housing lid 10 in position relative to the pressure block 15. The housing lid 10 and the pressure block 15 are connected to one another by means of screws or bolts 19.

The cooling valve arrangement 18 is in communication, via channels 20 and 21, with the pressure connection channels 16 and 17. This cooling valve arrangement 18 serves for branching off a stream of a substantially the same and constant volumetric flow rate from the return connection channel (either 16 or 17, depending on the sense of rotation of the shaft 3) and for supplying such stream to a leakage space 22 provided in the pressure member 9 for cooling purposes.

Figure 3:
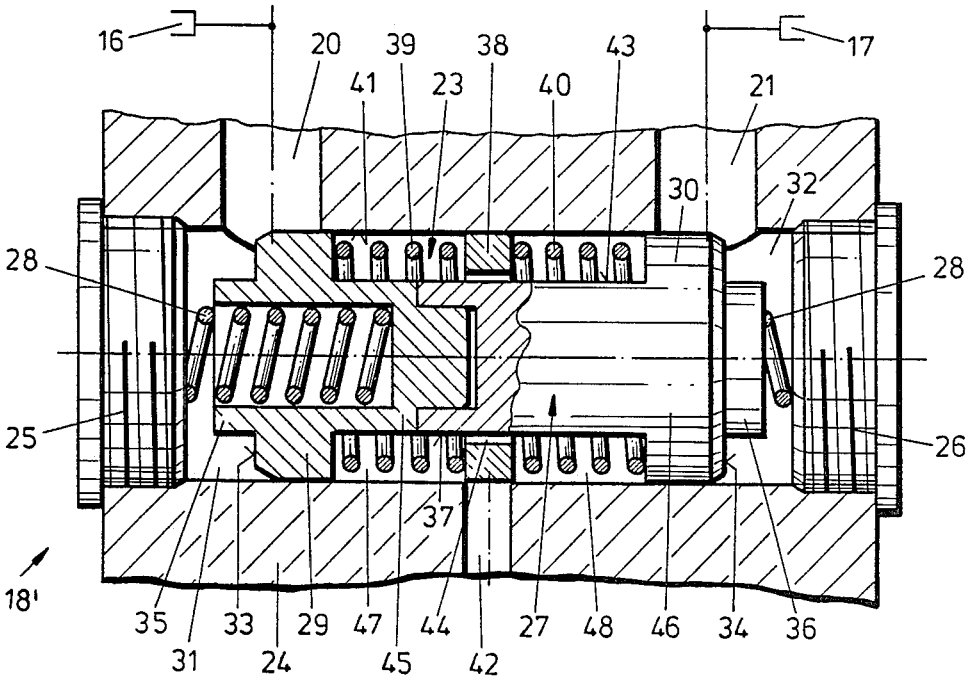
FIG. 3 is a longitudinal sectional view, at a relatively increased scale, of a valve arrangement of the present invention embodied in a cooling arrangement of the radial piston machine of FIGS. 1 and 2.
Figure 4:
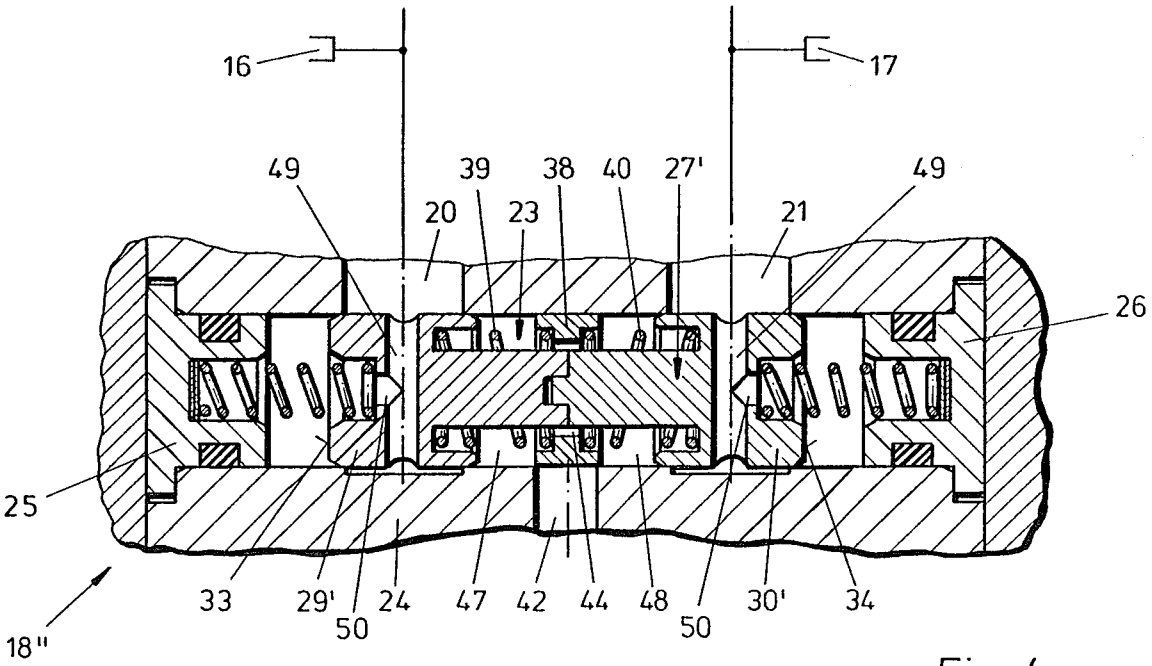
FIG. 4 is a view similar to that of FIG. 3 but depicting a modified construction of the valve arrangement.
Figure 5:
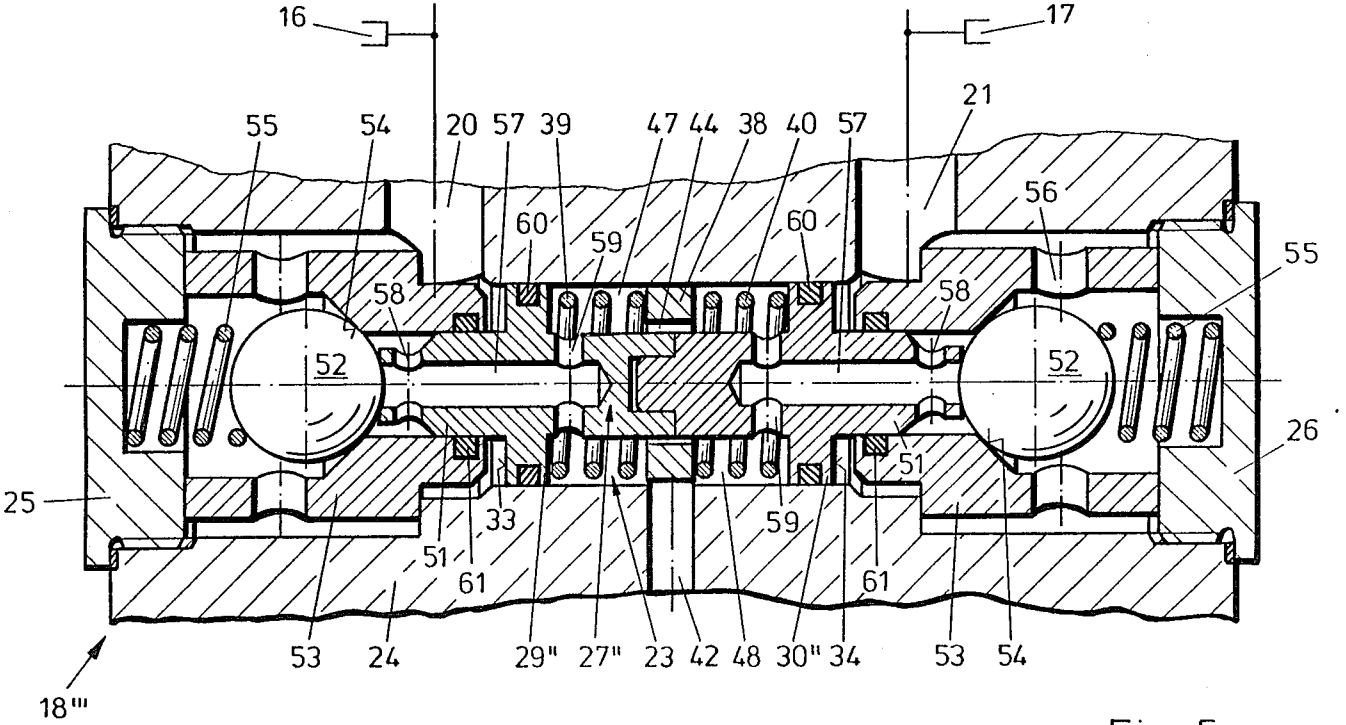
FIG. 5 is another view similar to those of FIGS. 3 and 4 but showing a further modification of the valve arrangement.

Various cooling valve arrangements, designated as 18', 18'' and 18''' for differentiation purposes, are illustrated in FIGS. 3, 4 and 5 of the drawing. In each instance, a connecting channel 23 is provided in a valve housing 24 between the channels 20 and 21 which lead to the pressure connection channels 16 and 17, respectively. The connecting channel 23 is closed, at its respective ends, by respective plugs 25 and 26. The plugs 25 and 26 are threaded in internally threaded end sections of the connecting channel 23 and are sealed in any known manner. In the construction depicted in FIGS. 2 and 4 of the drawing, the plugs 25 and 26 are supported in the axial direction by abutting against the housing lid 10.

In the construction particularly shown in FIG. 3 of the drawing, a piston 27 is slidingly received in the connecting channel 23. The piston 27 is supported, by means of compression springs 28 and 28' on the plugs 25 and 26, respectively, and is, in this manner, centered midway between the plugs 25 and 26 in a pressure-relieved state. Pressure spaces 31 and 32 are arranged at respective end faces of piston heads 29 and 30 of the piston 27 and are constantly in communication with the respective channels 20 and 21. To this end, annular collars 35 and 36 are provided at respective control surfaces 33 and 34 of the piston heads 29 and 30. These annular or cylindrical collars or portions 35 and 36 assure communication of the respective channels 20 and 21 with the associated pressure spaces 31 and 32 even in the event of abutment against one or the other of the plugs 25 and 26.

The piston 27 is provided, between the piston heads 29 and 30, with a reduced-diameter portion 37. The reduced-diameter portion 37 of the piston 27 is surrounded by, and carries, an annular closing member 38 which is centered midway of the piston 27 by means of springs 39 and 40 which brace themselves against the respective piston heads 29 and 30. The closing member 38 can slide on an internal surface 41 which circumferentially bounds the connecting channel 23. As a comparison with FIGS. 1 and 2 of the drawing will show, the closing member 38 closes, in the illustrated neutral position of the piston 27 and of the closing member 38, a connecting conduit 42 which leads to the leakage space 22. A hydraulic resistance in the form of an annular gap throttle 44 is provided between an external circumferential surface 43 of the reduced-diameter portion 37 of the piston 27 and the closing member 38.

The piston 27 proper consists of two longitudinal sections 45 and 46 which are centered with respect to one another, approximately at the central region of the piston 27, by means of a recess and a protuberance received in the recess, or in a similar fashion. In this manner, the installation and mounting of the closing member 38 as well as of the springs 39 and 40 on the piston 27 is facilitated or rendered possible to begin with.

Having so described the construction of the arrangement particularly depicted in FIG. 3, the operation of this arrangement will now be briefly discussed, still with reference to FIG. 3 of the drawing. When, for instance, the pressure prevailing in the pressure connection channel 16 is at a higher level than that in the pressure connection channel 17, then the piston 27 is displaced to the right, as considered in FIG. 3, from its neutral position to such an extent that the cylindrical collar or portion 36 ultimately abuts the plug 26 and is stopped thereby. During this displacement of the piston 27, the closing member 30 remains initially in its central position relative to the piston 27, due to the centering thereof by the springs 39 and 40, that is, it moves jointly with the piston 27. As a result, a spring receiving space 47 situated between the piston head 29 and the closing member 38 eventually becomes connected with the connecting or discharge conduit 42. At the same time, another spring receiving space 48, which is disposed between the piston head 30 and the closing member 38, remains separated from the discharge conduit 42 by the closing member 38.

Now, when the channel 21 in which the lower pressure prevails under the aforementioned circumstances is connected with the spring-receiving space 48 during the further rightward displacement of the piston 27, a pressure-differential builds up at the closing member 38, inasmuch as the hydraulic medium can at first flow out of the non-pressurized spring-receiving space 47 freely into the discharge conduit 42. However, this pressure differential causes a displacement of the closing member 38 against the forces of the centering springs 39 and 40 in the leftward direction with respect to the piston 27. Simultaneously, the operating medium flows through the annular throttling gap 44 from the spring-receiving space 48 into the spring-receiving space 47. Owing to the pressure difference which, as mentioned before, is effective on the closing member 38, the discharge flow-through cross-sectional area into the discharge conduit 42 is increasingly reduced, but the reduction rate gradually decreases, since gradually increasing pressure builds up in the spring-receiving space 47 which communicates with the discharge conduit, as the aforementioned flow-through cross-sectional area diminishes. Ultimately, the closing member 38 assumes a position in which the volumetric flow into the discharge conduit 42 has an approximately constant value independently of the pressure in the pressure connection conduit 17.

In the modified construction depicted in FIG. 4, where the same reference numerals or corresponding numerals supplemented with a prime have been used to identify similar parts, transverse bores 49 and 49' and axial tapping bores 50 and 50' are provided in piston heads 29' and 30' of a piston 27' which is also bipatite in this instance. Owing to this provision of the bores 49, 49', 50 and 50', the operating medium flows from the respective channels 20 and 21 through the associated transverse bores 49 or 49' and the axial tapping bores 50 or 50' toward the switching end faces 33 or 34 of the piston heads 29' or 30', respectively. This expedient serves the purpose of assuring that the piston 27' is in all positions thereof free of hydrostatic forces acting transversely of the axis of movement of the piston 27, which hydrostatic forces could otherwise result in an increased friction between the piston 27' and the surface bounding the connecting channel 23. In all other respects, the construction of the cooling valve arrangement 18" illustrated in FIG. 4 corresponds to that of the cooling valve arrangement 18' described above in conjunction with FIG. 3, and operates in an analogous manner.

In FIG. 5, there is depicted another modification and again the same reference numerals or corresponding reference numerals supplemented with a double prime are being used to identify the same or similar parts therein. In this modification, respective piston heads 29" and 30" are provided with hollow extensions 51 and 51' of nozzle-shaped configurations which are in communication with the spring-receiving spaces 47 and 48, respectively. The extensions 51 and 51' abut respective spherical, spring-loaded closing members 52 and 52' which are guided in respective sockets 53 and 53' which are provided with respective sealing seats 54 and 54'. Respective springs 55 and 55' urge the closing members 52 toward and against the sealing seats 54 and 54'.

When the piston 27" of this modified construction of the arrangement 18"' is displaced in the rightward direction, then the closing member 52' is lifted off from its sealing seat 54', so that the operating medium can now flow from the channel 21 around the periphery of the socket 53', then through radial bores 56' into the interior of the socket 53' and from there through the interior of the extension or nozzle 51' which is provided with a longitudinal bore 57' and transverse bores 58' and through additional transverse bores 59' into the spring-receiving space 48. The subsequent displacement of the closing member 38 occurs analogously to the operation described above in connection with FIG. 3. The piston 27" is further provided with bores 56, 57, 58 and 59 which are ineffective during such rightward displacement due to the closing action of the closing member 52 in cooperation with the sealing seat 54, but are effective during the displacement of the piston 27'' leftwardly beyond the neutral position.

It can further be seen in FIG. 5 that the piston heads 29'' and 30'' are sealed with respect to the valve housing 24 by respective seals 60 and 60' and that the nozzle-like extensions 51 and 51' are sealed with respect to the respective sockets 53 and 53' by means of respective seals 61 and 61'.

It will be understood that each of the elements described above, or two or more together, may also find a useful application in other types of arrangements differing from the type described above.

While the invention has been illustrated and described as embodied in a reversible hydraulic motor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. A distributing valve arrangement for a reversible hydraulic machine, particularly a hydraulic motor, having two connecting passages for the supply and discharge of a hydraulic operating medium at different pressures to and from the machine, comprising wall means defining a circumferential surface for bounding a connecting channel between the connecting passages; a piston received in said connecting channel for displacement in opposite directions from a neutral position thereof and including two piston heads having respective end faces, and a reduced-diameter central portion extending between said piston heads; spring means for biasing said piston toward said neutral position thereof; means for admitting the hydraulic operating medium from each of the connecting passages to a different one of said end faces for the higher of the pressures prevailing in the connecting passages to displace said piston against the action of said spring means out of said neutral positions and toward a respective end position thereof; conduit means formed in said wall means for discharging the hydraulic operating medium from a region of said connecting channel that is delimited by said piston heads and said central portion of said piston; a central closing member supported on said central portion of said piston and being slidable on said circumferential surface of said wall means so as to open or close said conduit means, said central closing member being positioned in said wall means so as to limit in the region of said conduit means two spring-receiving spaces in said region; two centering spring means received in said spring-receiving spaces, respectively and urging said closing member toward a central position thereof relative to said piston, in which it interrupts communication between said region and said discharging means when said piston is in said neutral position thereof; and means including a hydraulic resistance for establishing communication between said two spring-receiving spaces.

2. The arrangement as defined in claim 1, wherein said piston includes communication control means for interrupting communication of said spring-receiving spaces with associated ones of the connecting passages in said neutral position of said piston, and for establishing such communication with only that of the connecting passages which has the lower pressure prevailing therein during the displacement of said piston toward the respective end position thereof.

3. The arrangement as defined in claim 1, wherein said closing member has an annular configuration; and wherein said hydraulic resistance is constituted by an annular throttling gap between said closing member and said central portion of said piston.

4. The arrangement as defined in claim 1, wherein said piston is provided at said end faces of said piston heads thereof with annular spacing projections.

5. The arrangement as defined in claim 1, wherein said admitting means includes connecting bore means in said piston heads which lead from the respective connecting passages to the respective end faces of said piston heads.

6. The arrangement as defined in claim 1, wherein said piston heads include sleeve-shaped extensions which are hollow and communicate with the respective ones of said spring-receiving spaces; and further comprising spring-loaded closing elements which abut said sleeve-shaped extensions.

7. The arrangement as defined in claim 6; further comprising respective sockets received in said connecting channel and provided with respective sealing seats; and wherein said closing elements are spherical, are received in said sockets, and cooperate with said sealing seats to interrupt communication between the respective connecting passages and the associated spring-receiving spaces unless lifted off by said sleeve-shaped extensions.

8. The arrangement as defined in claim 1, wherein said piston includes two separate parts which are centered with respect to one another substantially at the central region of said piston.

* * * * *